US012551819B2

(12) United States Patent
Chang

(10) Patent No.: US 12,551,819 B2
(45) Date of Patent: Feb. 17, 2026

(54) WATERPROOF HEATING MODULE FOR SMOKE GENERATOR

(71) Applicant: NOVACORP INC., Guangzhou (CN)

(72) Inventor: Ming-Cheng Chang, Tainan (TW)

(73) Assignee: NOVACORP INC., Guangzhou (CN)

( * ) Notice: Subject to any disclaimer, the term of this patent is extended or adjusted under 35 U.S.C. 154(b) by 414 days.

(21) Appl. No.: 18/474,024

(22) Filed: Sep. 25, 2023

(65) Prior Publication Data

US 2024/0342627 A1 Oct. 17, 2024

(30) Foreign Application Priority Data

Apr. 13, 2023 (TW) ..... 112203377

(51) Int. Cl.
*A63J 5/02* (2006.01)
*F41H 9/06* (2006.01)

(52) U.S. Cl.
CPC ..... *A63J 5/025* (2013.01); *F41H 9/06* (2013.01)

(58) Field of Classification Search
CPC ..... A63J 5/025; F41H 9/00; F41H 9/06
See application file for complete search history.

(56) References Cited

U.S. PATENT DOCUMENTS 4,764,660 A * 8/1988 Swiatosz ..... F41H 9/06 392/397
8,917,980 B2 * 12/2014 Scully ..... A63J 5/025 392/397
2023/0149957 A1 * 5/2023 Ziemkowski ..... B05B 7/1606 239/13

FOREIGN PATENT DOCUMENTS

CN 213698839 U * 7/2021
CN 216023176 U * 3/2022
EP 4445977 A1 * 10/2024 ..... A63J 5/025

* cited by examiner

*Primary Examiner* — Nathan J Flynn
(74) *Attorney, Agent, or Firm* — Che-Yang Chen; Law Office of Michael Chen

(57) ABSTRACT

A waterproof heating module for a smoke generator comprises a heat exchanger (45) including an ejection portion (115) configured to eject smoke. The heat exchanger (45) is received in an inner side of an outer casing (135). The ejection portion (115) extends through a through-hole (139) of the outer casing (135) to an outer side of the outer casing (135). A closure plate (155) includes a closure face (157) and a coupling hole (159) extending through the closure face (157). The coupling hole (159) of the closure plate (155) has an inner periphery (160) in waterproof coupling with an outer periphery of the ejection portion (115). The ejection portion (115) extends out of the closure plate (155) via the coupling hole (159). The closure face (157) of the closure plate (155) is in waterproof coupling with the through-hole (139) of the outer casing (135).

11 Claims, 14 Drawing Sheets

WATERPROOF HEATING MODULE FOR SMOKE GENERATOR

BACKGROUND OF THE INVENTION

The present invention relates to a waterproof heating module for a smoke generator and, more particularly, to a waterproof heating module for a smoke generator capable of heating and vaporizing smoke liquid into a smoke which is released into the air to generate a smoky effect.

A smoke generator currently available on the market includes a heating module which heats and, thus, vaporizes a smoke liquid (or so-called "smoke oil") into smoke which is released into the air to generate a smoky effect. Such a smoke generator may be used in an outdoor space, such as an outdoor stage. This smoke generator, when used in a rainy day, may encounter a water leakage problem. The electric circuit generally used in the smoke generator for controlling purposes may be damaged more quickly by the moisture, which may even adversely affect normal operation of the smoke generator. When water enters the heating module, the temperature of the heating module is reduced.

Furthermore, an ejection portion of the smoke generator must extend to the outer side of the smoke generator and couple with the structure of the smoke generator. Thus, the temperature at the ejection portion tends to drop (which may even be lower than 200° C.) due to the structure of the smoke generator and excellent heat exchange efficiency with the atmosphere. When the temperature at the ejection portion is not high enough, the atomization effect of the smoke liquid is poor, and the smoke could condense due to the temperature difference and becomes the smoke liquid again.

BRIEF SUMMARY OF THE INVENTION

To solve the above problem, the present invention provides a waterproof heating module for a smoke generator. The waterproof heating module comprises:

- a heat exchanger including an ejection portion and a vaporization pipeline, wherein the vaporization pipeline includes an outlet end, wherein the ejection portion includes an engaging end and a tightening hole extending from the engaging end, and wherein the outlet end of the vaporization pipeline is coupled with the ejection portion;
- a tightening member including a sealing hole, wherein the tightening member is received in the tightening hole and is sandwiched between the ejection portion and the outlet end of the vaporization pipeline; and
- a fixture including a receptacle, wherein the fixture is coupled with the coupling end of the ejection portion and is configured to squeeze the tightening member to provide waterproof coupling between an inner surface of the sealing hole of the tightening member and an outer surface of the outlet end of the vaporization pipeline, and wherein an outer surface of the tightening member is in waterproof coupling with an inner surface of the tightening hole of the ejection portion.

When the tightening member is squeezed by the fixture, the tightening member is in waterproof coupling with the outlet end of the vaporization pipeline, and the tightening member is also in waterproof coupling with the ejection portion. Thus, water is difficult to enter the ejection portion, and the ejection portion can be maintained at the working temperature (above 200° C.) more easily.

In another aspect, the present invention provides a waterproof heating module for a smoke generator. The waterproof heating module comprises:

- a heat exchanger including an ejection portion configured to eject smoke;
- an outer casing including a through-hole, wherein the heat exchanger is received in an inner side of the outer casing, wherein the ejection portion extends through the through-hole of the outer casing to an outer side of the outer casing; and
- a closure plate including a closure face and a coupling hole extending through the closure face, wherein the coupling hole of the closure plate has an inner periphery in waterproof coupling with an outer periphery of the ejection portion, wherein the ejection portion extends out of the closure plate via the coupling hole, and wherein the closure face of the closure plate is in waterproof coupling with the through-hole of the outer casing.

The closure plate is in waterproof coupling with the outer casing and the ejection portion, such that water cannot enter the interior of the inner casing via the gap between the closure plate and the outer casing and the gap between the closure plate and the ejection portion, thereby providing excellent waterproof effect.

In an example, the closure plate is a sheet having a thickness of 0.2-0.3 mm, such that the inner periphery of the closure plate and the outer periphery of the ejection portion are coupled to have a low heat exchange efficiency therebetween.

The thickness of the closure plate is 0.2-0.3 mm, such that the contact area between the closure plate and the ejection portion is very small. Thus, the heat conduction efficiency between the closure plate and the ejection portion is relatively low.

In an example, the ejection portion includes a coupling portion. The inner periphery of the closure plate is disposed around the coupling portion. The inner periphery of the closure plate and the coupling portion are welded together.

The inner periphery of the closure plate and the coupling portion are welded together, such that water is difficult to pass through the gap between the ejection portion and the closure plate, thereby enhancing the waterproof effect.

In an example, the waterproof heating module further comprises a fixture. The ejection portion includes an engaging end and a coupling portion contiguous to the engaging end. The inner periphery of the closure plate is disposed around the coupling portion. A peripheral wall delimiting the coupling hole of the closure plate is securely sandwiched between the fixture and the coupling portion. The inner periphery of the closure plate and the coupling portion are welded together to provide a waterproof coupling therebetween.

The coupling portion is provided on the ejection portion, and the peripheral wall delimiting the coupling hole of the closure plate is sandwiched between the fixture and the coupling portion, such that water is difficult to pass through the gap between the ejection portion and the closure plate, thereby enhancing the waterproof effect.

In an example, the waterproof heating module further comprises an inner casing and a temperature maintaining member. The inner casing is disposed between the outer casing and the heat exchanger. The heat exchanger and the inner casing are coupled to have a low heat exchange efficiency therebetween. The ejection portion is in waterproof coupling with the inner casing. The temperature maintaining member is disposed between the inner casing and the heat exchanger. The temperature maintaining member reduces heat exchange efficiency between the heat exchanger and air.

The inner casing cooperates with the outer casing to reduce the chance of water entering or contacting with the heat changer, such that the heat exchanger can be better maintained at the working temperature. The temperature maintaining member can reduce the heat exchange efficiency between the heat exchanger and the air, such that the heat exchanger can be better maintained at the working temperature.

In an example, the waterproof heating module further comprises a first venting valve capable of preventing passage of water. The first venting valve includes a flange having a first end face and a second end face spaced from the first end face. The first venting valve further includes a coupling portion extending from the first end face away from the second end face. The first venting valve further includes an inner passageway extending from the coupling portion and a chamber located between the inner passageway and the second end face. The first venting valve further includes an outer passageway extending from an outer periphery of the flange and extending to and intercommunicating with the chamber. The inner passageway intercommunicates with an interior of the outer casing. An air-permeable waterproof member is securely disposed in the chamber.

The smoke generator according to the present invention can balance the pressure in the heating module and the atmospheric pressure by disposing the first venting valve on the outer casing of the heating module, further enhancing the waterproof effect of the heating module.

In an example, the waterproof heating module further comprises a plurality of first waterproof kits. Each of the plurality of first waterproof kits includes a body coupled to the outer casing, a squeezing member, and a locking cover. Each body includes a coupling hole and a squeezing chamber intercommunicating with the coupling hole, wherein each squeezing member is received in an associated squeezing chamber. Each locking cover is in threading connection with an associated body. The heat exchanger further includes a vaporization pipeline and a heater configured to conduct heat exchange with the vaporization pipeline. The vaporization pipeline further includes an inlet end, wherein a line for the heater extends to an outer side of the outer casing. The coupling hole and the squeezing member of one of the plurality of first waterproof kits is coupled with the inlet end of the vaporization pipeline. The coupling holes and the squeezing members of remaining first waterproof kits are coupled with the line for the heater. When the locking covers of the plurality of first waterproof kits are rotated to a tightened state, the squeezing member of the one of the plurality of first waterproof kits is waterproof coupling with the inlet end of the vaporization pipeline and an associated body, and the squeezing members of the remaining first waterproof kits are in waterproof coupling with the line for the heater and associated bodies.

In an example, the waterproof heating module further comprises a tightening member and a fixture. The heat exchanger further includes a vaporization pipeline having an outlet end. The ejection portion includes an engaging end and a tightening hole extending from the engaging end. The tightening member includes a sealing hole. The tightening member is received in the tightening hole and is disposed between the outlet end of the vaporization pipeline and the ejection portion. The fixture has a receptacle. The fixture is coupled with the engaging end of the ejection portion and is configured to squeeze the tightening member to provide waterproof coupling between an inner surface of the sealing hole and an outer surface of the outlet end of the vaporization pipeline. An outer surface of the tightening member is in waterproof coupling with an inner surface of the tightening hole of the ejection portion. The vaporization pipeline is aligned with the receptacle.

When the tightening member is squeezed by the fixture, the tightening member is in waterproof coupling with the outlet end of the vaporization pipeline, and the tightening member is also in waterproof coupling with the ejection portion. Thus, water is difficult to enter the ejection portion, and the ejection portion can be maintained at the working temperature (above 200° C.) more easily.

In an example, an end face of the outlet end is located between an end face of the fixture and the tightening member. The tightening member includes two conic faces on two faces thereof. The distal end of the tightening hole is conic. When the tightening member is squeezed, the tightening member is aligned with a central axis of the tightening hole.

The present invention will become clearer in light of the following detailed description of illustrative embodiments of this invention described in connection with the drawings.

Figure 1:
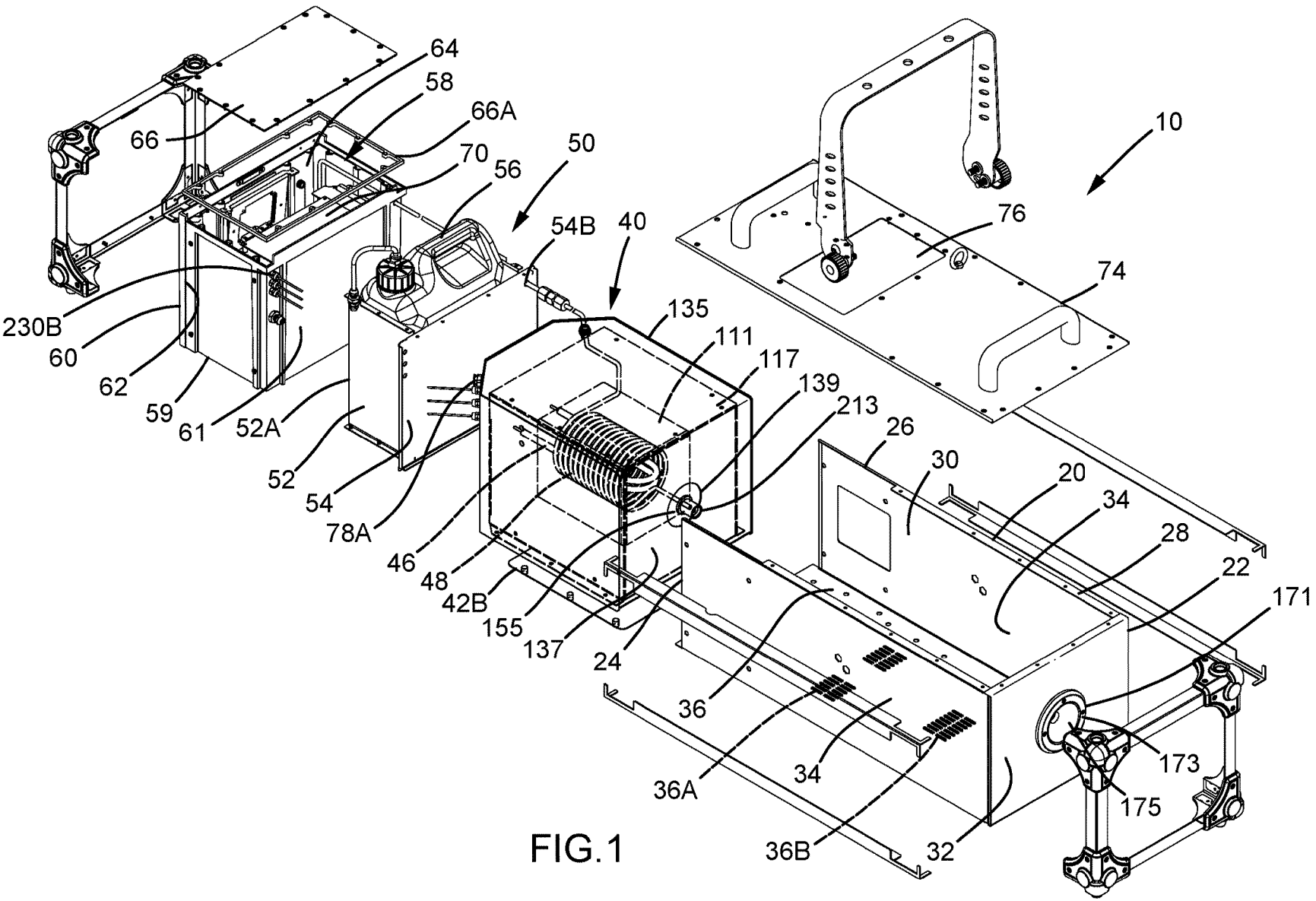
FIG. 1 is an exploded, perspective view of a smoke generator according to the present invention.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "side", "end", "portion", "longitudinal", "circumferential", "horizontal", "vertical", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

The present invention relates to a smoke generator capable of heating and vaporizing a smoke liquid into smoke which is released into the air to generate a smoky effect. The smoke generator may include a heating module and a controlling module. Both the heating module and the controlling module may be waterproof and may meet the regulations of IP67 (International Protection Marking).

With reference to FIGS. 1-8, the smoke generator 10 comprises a housing 20 having a first end 22 and a second end 24 spaced from the first end 22. The housing 20 further includes an upper end 26 extending between the first and second ends 22 and 24. The housing 20 further includes an installation space 30 extends from the upper end 26 to the second end 24 but spaced from the first end 22. Namely, the installation space 30 forms an opening on each of the upper end 26 and the second end 24.

The housing 20 further includes a first end wall 32 at the first end 22 and a bottom wall 36 spaced from and opposite to the upper end 26. The housing 20 further includes two sidewalls 34 parallel to each other and extending between the first end wall 32 and the bottom wall 36. The installation space 30 is substantially delimited by the two sidewalls 34, the first end wall 32, and the bottom wall 36. The bottom wall 36 includes a plurality of drain holes 36A and a plurality of through-holes 36B. Each of the plurality of drain holes 36A and the plurality of through-holes 36B intercommunicates with the installation space 30 and the atmosphere. The plurality of drain holes 36A is located between the plurality of through-holes 36B and the second end 24. The plurality of through-holes 36B is located between the plurality of drain holes 36A and the first end 22. The first end wall 32 includes an outlet 38 intercommunicating with the installation space 30 (see FIG. 3B). The upper end 26 includes a substantially U-shaped upper wing 28. In this embodiment, a side of the upper wing 28 is contiguous to the first end wall 32 and spaced from the second end 24.

Figure 3A:
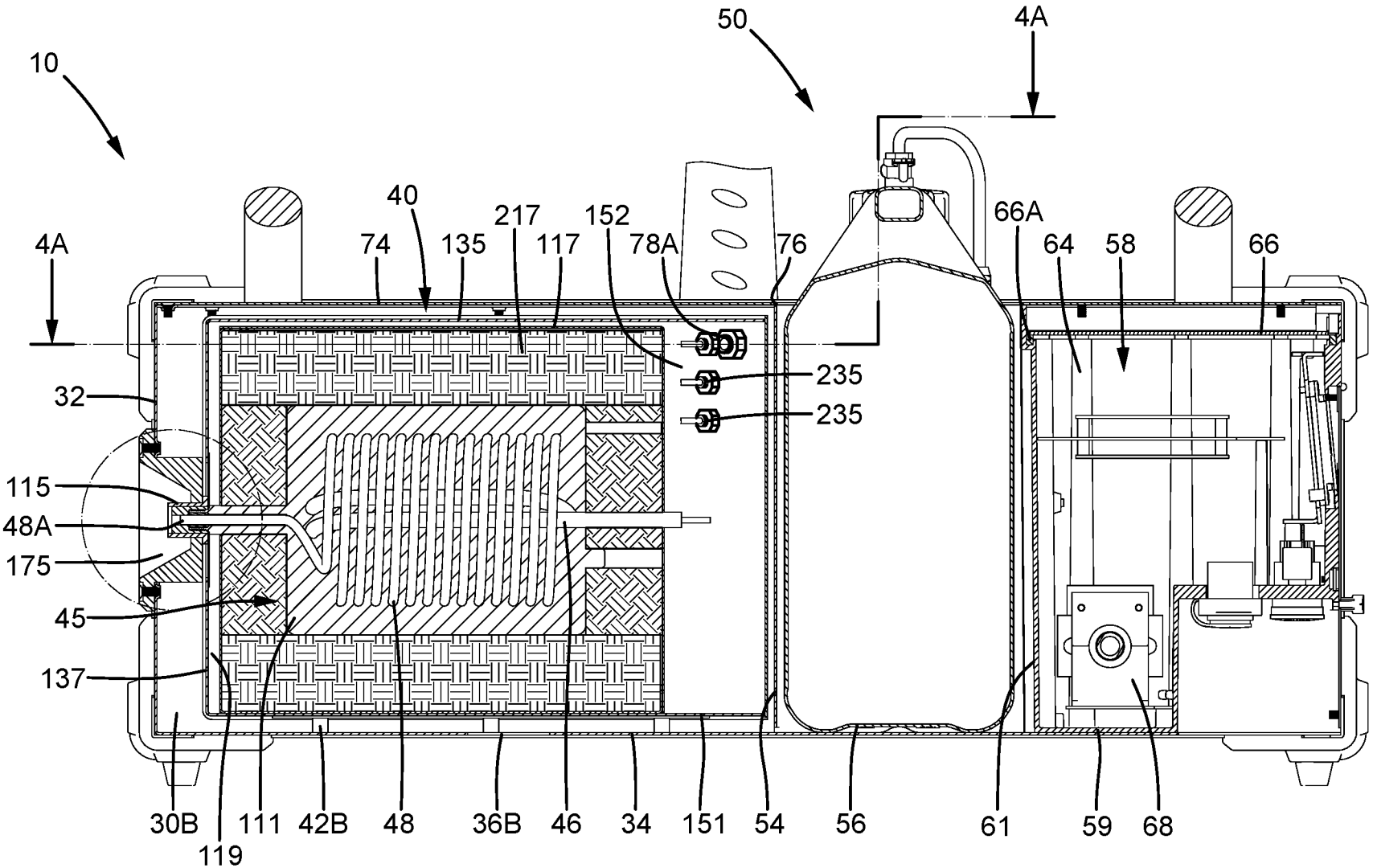
FIG. 3A is a cross sectional view taken along section line 3A-3A of FIG. 2.
Figure 3B:
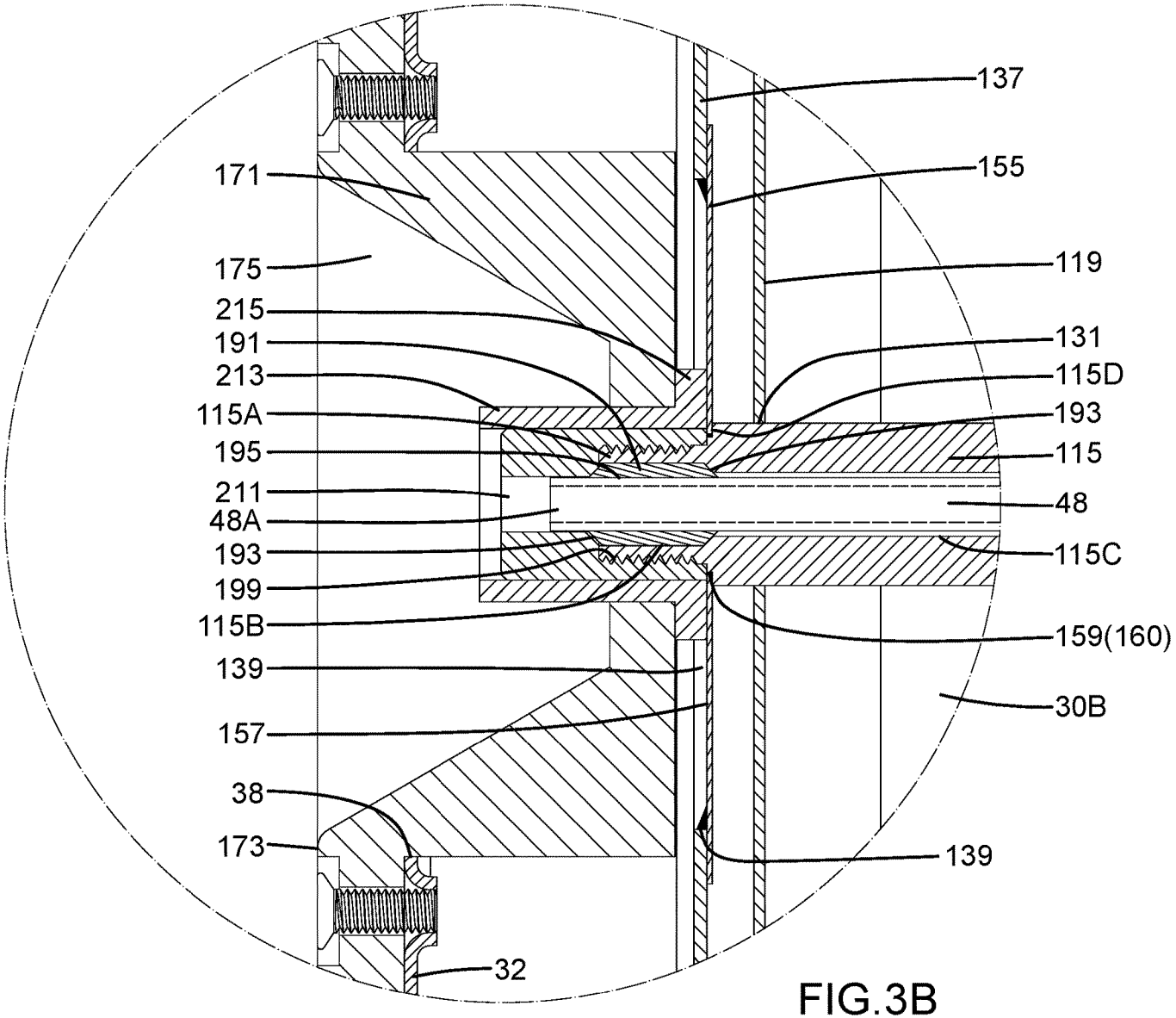
FIG. 3B is an enlarged view of a circled portion of FIG. 3A.
Figure 4A:
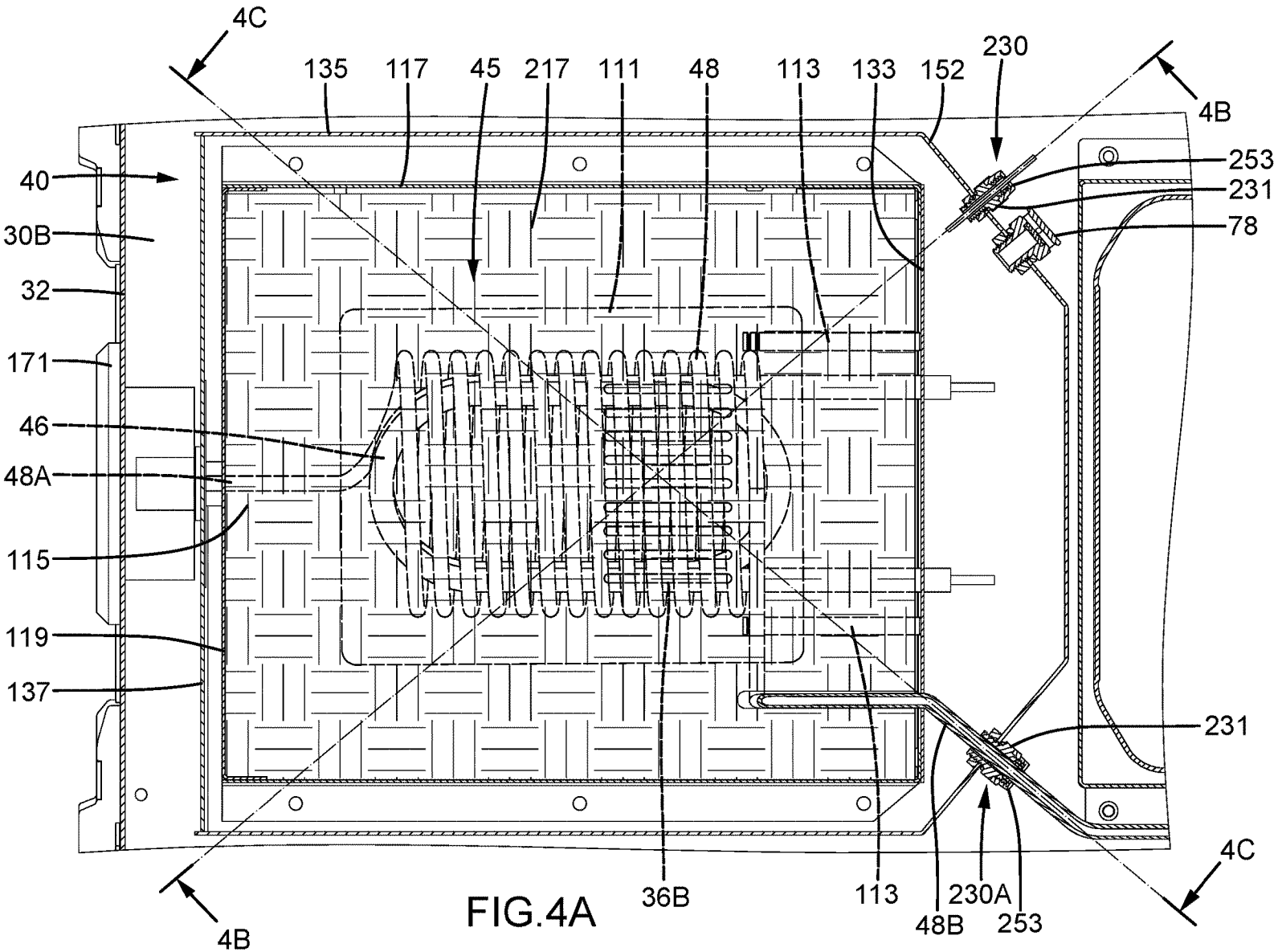
FIG. 4A is a cross sectional view taken along section line 4A-4A of FIG. 3A.
Figure 4B:
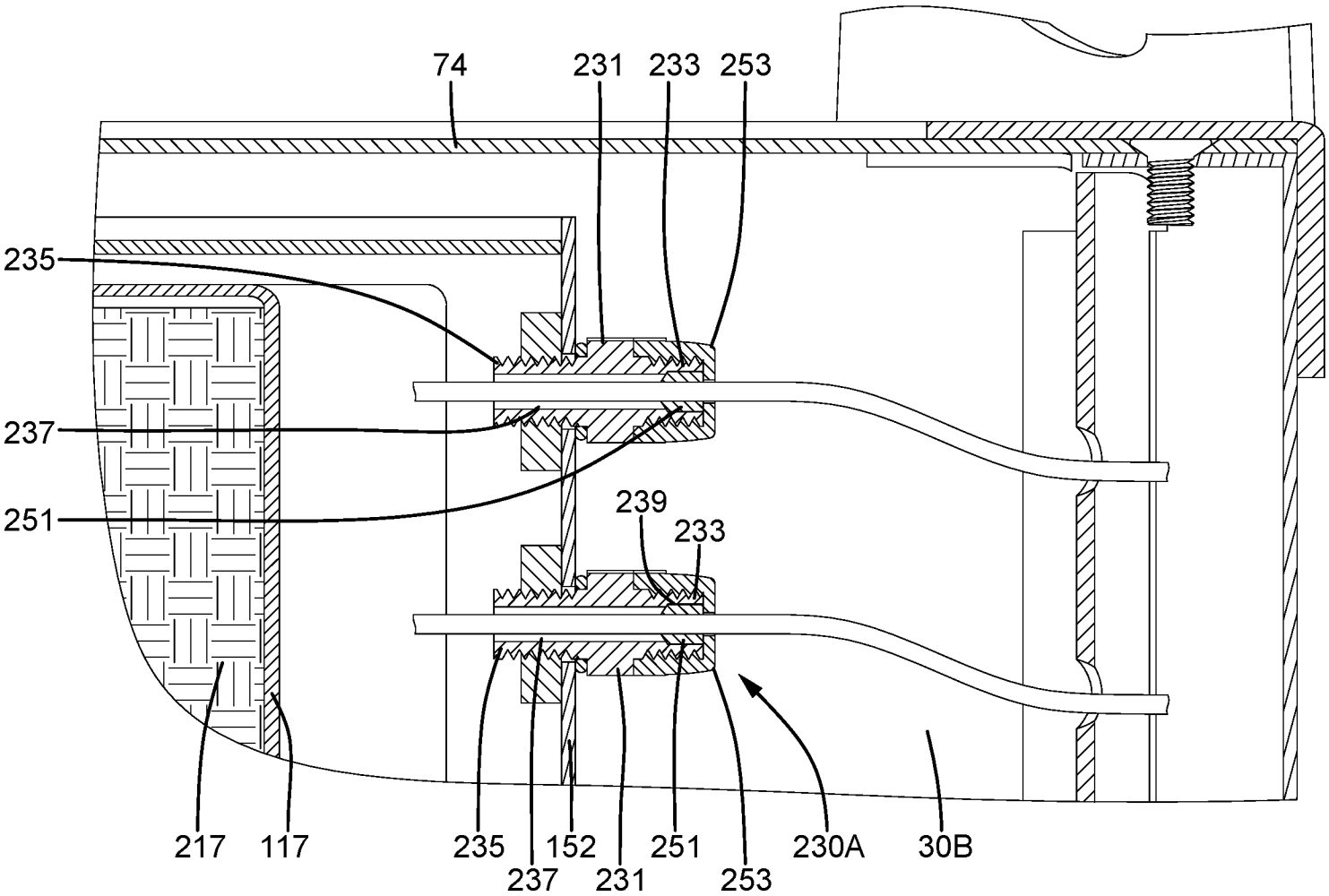
FIG. 4B is a cross sectional view taken along section line 4B-4B of FIG. 4A.
Figure 4C:
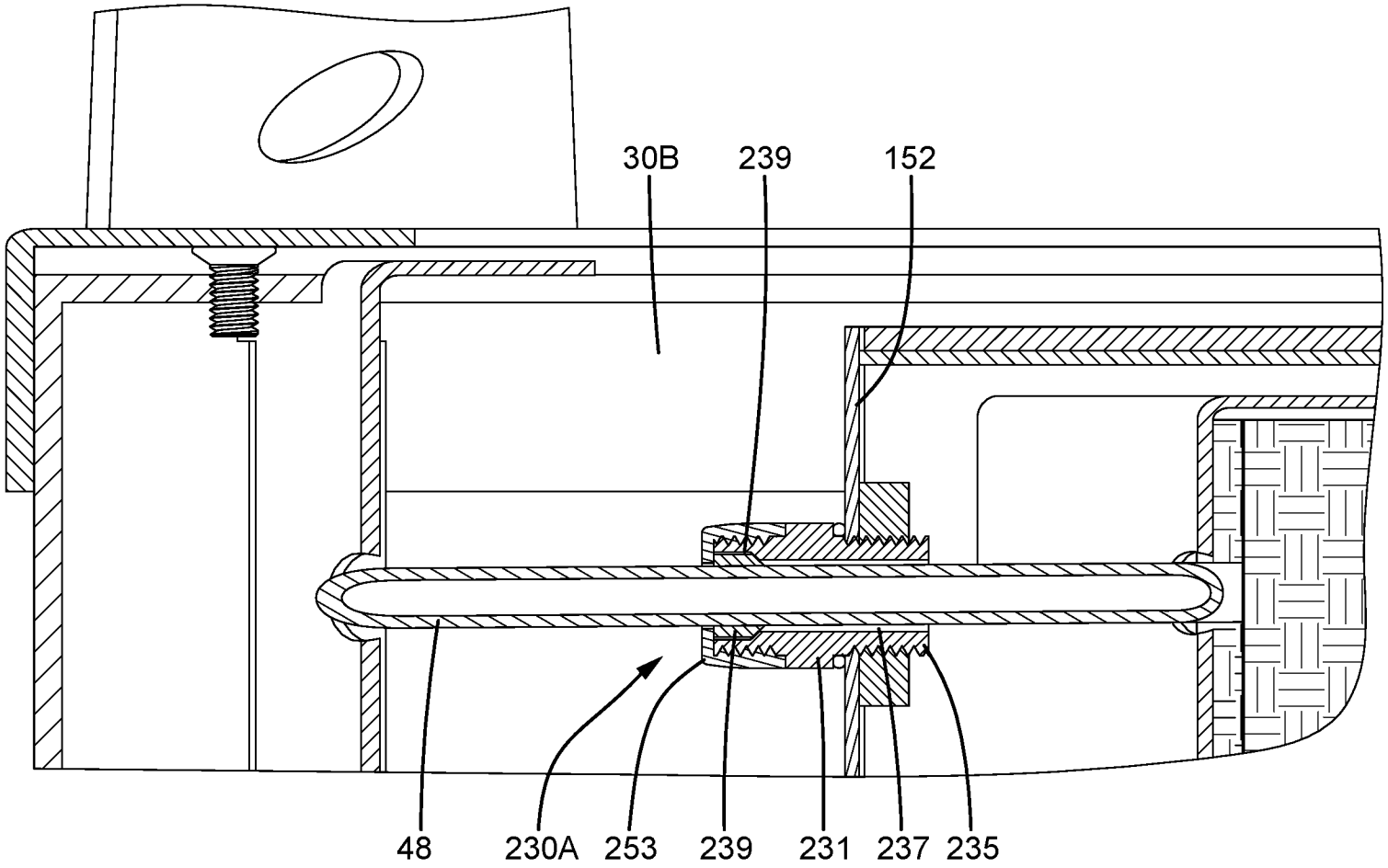
FIG. 4C is a cross sectional view taken along section line 4C-4C of FIG. 4A.
Figure 5:
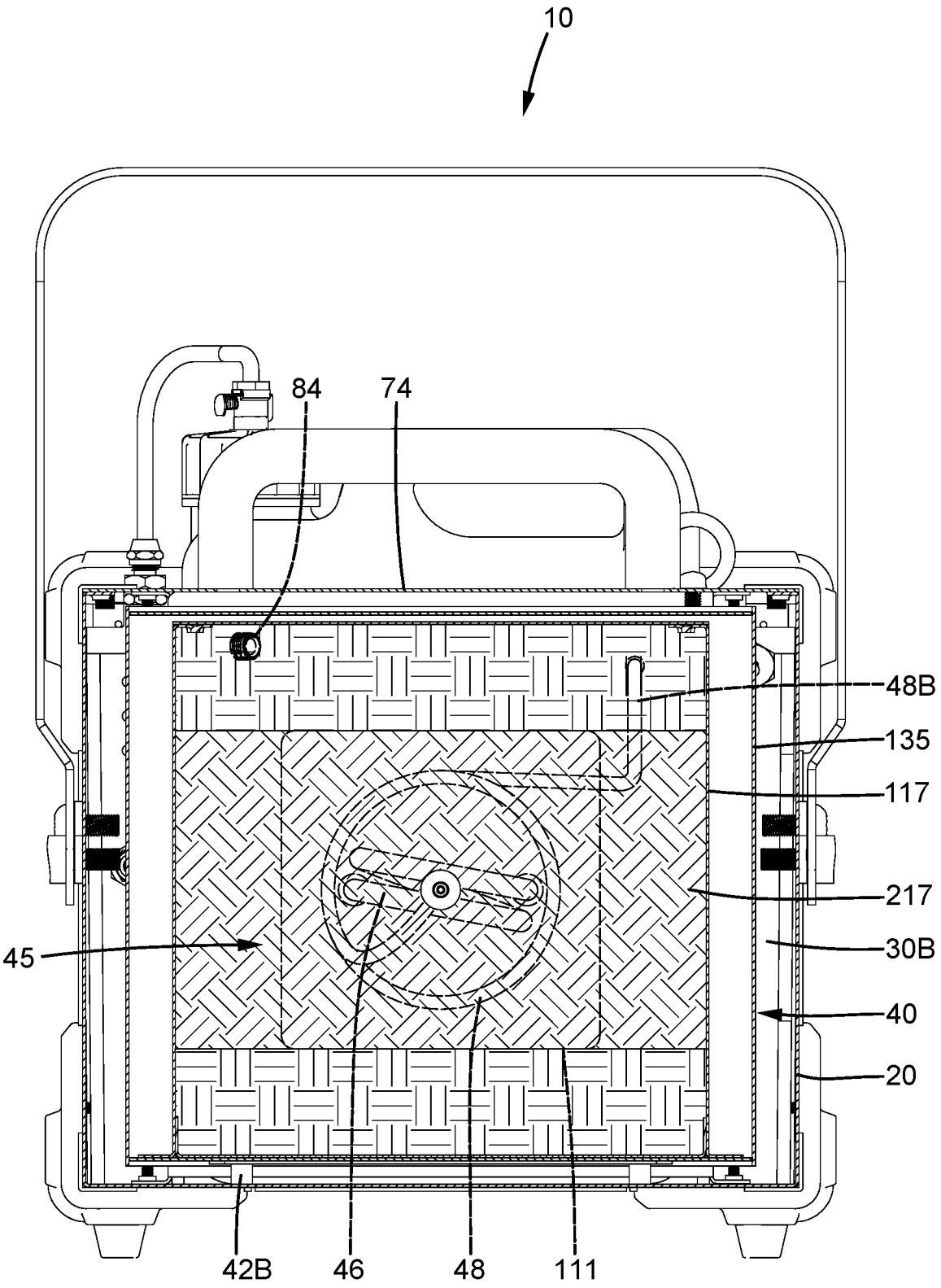
FIG. 5 is a cross sectional view taken along section line 5-5 of FIG. 2.
Figure 6:
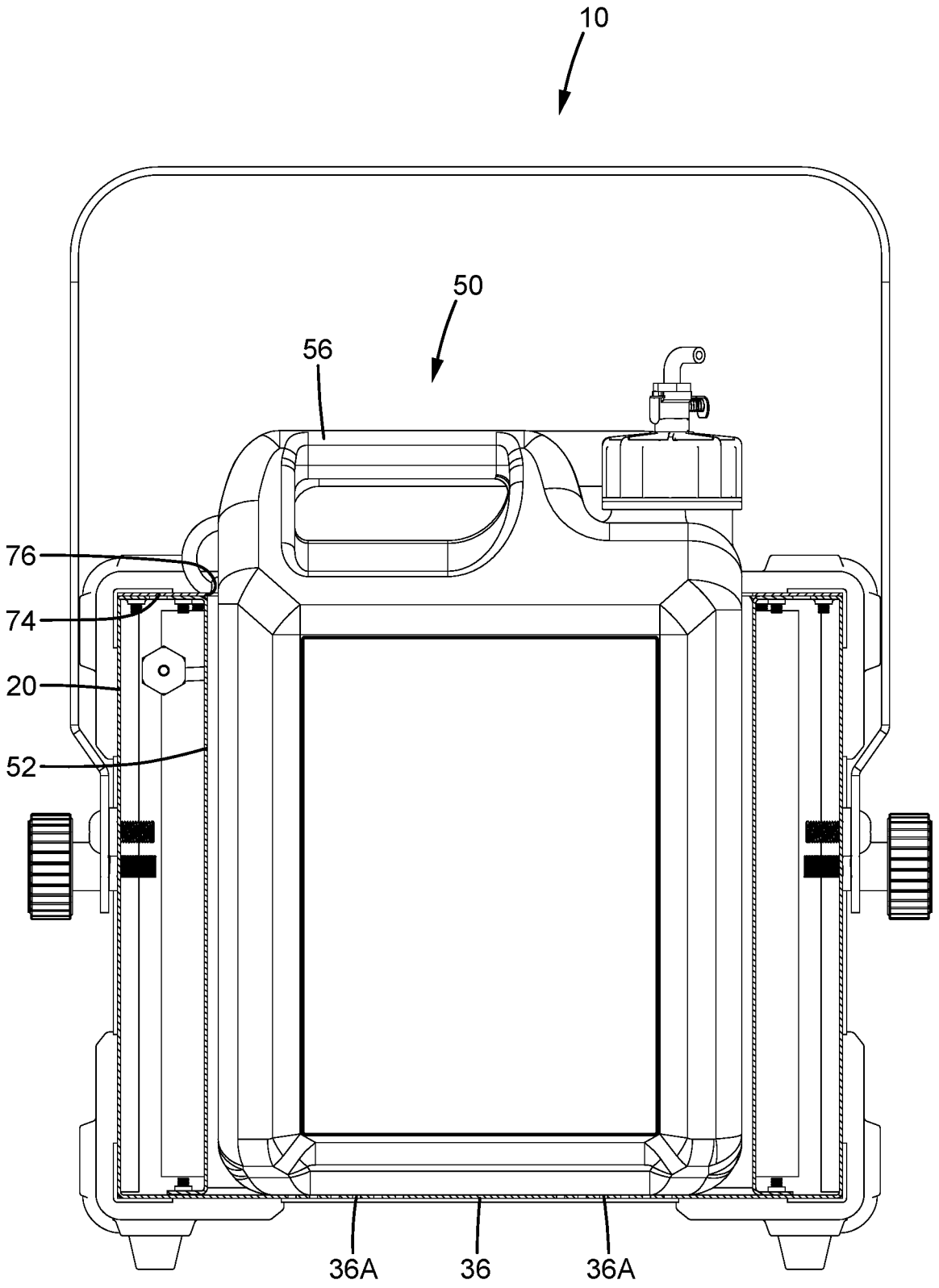
FIG. 6 is a cross sectional view taken along section line 6-6 of FIG. 2.

With reference to FIGS. 1 and 3B, an outer protecting ring 171 is securely disposed on the outlet 38 of the housing 20. The outer protecting ring 171 includes an outer side 173 and an inner side 174. The outer protecting ring 171 further includes a countersink 175 in the form of a conic hole in the outer side 173 and extending to the inner surface 174. The outer protecting ring 171 is fixed to the outlet 38 of the first end wall 32. The outer side 173 is more protrusive than the first end wall 32 of the housing 20. The inner side 174 is located in the installation space 30 (inside an enclosing area 30B).

The smoke generator 10 further comprises a heating module 40 received in the installation space 30 and disposed on the first end 22. The heating module 40 includes an inner casing 117 and a heat exchanger 45 disposed in the inner casing 117. The inner casing 117 is substantially a parallelepiped and is not completely sealed. The inner casing 117 includes a first side 119 and a second side 133 spaced from the first side 119. The inner casing 117 further includes a through-hole 131 extending through the first side 119. The inner casing 117 is received in the installation space 30 and is adjacent to the first end wall 32. The through-hole 131 is aligned with the outlet 38 and the countersink 175.

With reference to FIGS. 1A-1C and 3A-3B, the heat exchanger 45 includes a heater 46, a vaporization pipeline 48, and a thermally conductive member 111. An ejection portion 115 extends from an outer surface of the thermally conductive member 111. The ejection portion 115 includes an engaging end 115A on a distal end thereof and a coupling portion 115D adjacent to the engaging end 115A. The coupling portion 115D is in the form of a stepped portion having an outer diameter smaller than a maximum diameter of the ejection portion 115 (see FIG. 3B). The engaging end 115A includes an outer threading. The ejection portion 115 further includes a tightening hole 115B extending from an end of the engaging end 115A and a vaporization pipeline hole 115C extending from an inner face of the tightening hole 115B. A conic face is formed at an intersection of the tightening hole 115B and the vaporization pipeline hole 115C. An inner diameter of the tightening hole 115B is greater than an inner diameter of the vaporization pipeline hole 115C.

The vaporization pipeline 48 is received in the thermally conductive member 111 and helically surrounds the heater 46. The thermally conductive member 111 is coupled with the heater 46 and the vaporization pipeline 48 to permit heat exchange therebetween. In a non-restrictive example, the thermally conductive member 111 may be in the form of an aluminum block in contact with and enclosing the heater 46 and the vaporization pipeline 48, such that the heater 46 and the vaporization pipeline 48 may have a good heat exchange efficiency therebetween. The vaporization pipeline 48 includes an outlet end 48A coupled with the vaporization pipeline hole 115C of the ejection portion 115 and extending through the tightening hole 115B to the outer side of the engaging end 115A. The outer diameter of vaporization pipeline 48 is smaller than the inner diameter of the tightening hole 115B. The vaporization pipeline 48 includes an inlet end 48B extending to the outer side of the heater 46.

The heat changer 45 further includes a tightening member 191 and a fixture 197. The tightening member 191 has two conic faces 193 formed on two ends thereof. The tightening member 191 further includes a sealing hole 195 extending between the two ends thereof. The tightening member 191 may, but not limited to, be made of copper. The tightening member 191 is received in the tightening hole 115B. A portion of the vaporization pipeline 48 adjacent to the outlet end 48A is coupled with the sealing hole 195. When the tightening member 191 is not pressed, the tightening member 191 and the inner surface of the tightening hole 115B may (but not limited to) have a loose-fit connection therebetween, and the tightening member 191 and the vaporization pipeline 48 may also (but not limited to) have a loose-fit connection therebetween.

The fixture 197 includes a receptacle 211 extending from a first end face thereof towards but spaced from a second end face thereof. The fixture 197 further includes an engaging hole 199 extending from an end wall of the receptacle 211 to the second end face. The engaging hole 199 has an inner threading. An inner diameter of the engaging hole 199 is greater than an inner diameter of the receptacle 211. The engaging hole 199 of the fixture 197 is in threading connection with the engaging end 115A of the ejection portion 115. The outlet end 48A of the vaporization pipeline 48 extends into the receptacle 211 (see FIG. 3B).

When the fixture 197 is tightened, the tightening member 191 is squeezed and deforms. Furthermore, the tightening member 191, the tightening hole 115B, and the outlet end 48A of the vaporization pipeline 48 are in tight-fit connection, such that a sealing state is formed between the tightening member 191 and the inner surface of the tightening hole 115B and between the tightening member 191 and the outlet end 48A of the vaporization pipeline 48. This prevents water from leaking into an interior of the ejection portion 115 via a gap between the tightening member 191 and the inner surface of the tightening hole 115B or via a gap between an inner surface of the tightening member 191 and an outer surface of the vaporization pipeline 48. Furthermore, with reference to FIG. 3B, it is worth mentioning that the end face of outlet end 48A of the vaporization pipeline 48 is located between an end face of the fixture 197 and the tightening member 191. Namely, the outlet end 48A of the vaporization pipeline 48 is received in the receptacle 211 of the fixture 197, and the end face of the outlet end 48A and is located between the outer end face of the fixture 197 and the tightening member 191 in a longitudinal direction of the fixture 197.

Specifically, due to provision of the two conic faces 193 of the tightening member 191 and the conic face at the intersection of the tightening hole 115B and the vaporization pipeline hole 115C, when the tightening member 191 is squeezed, the tightening member 191 automatically aligns with the central axis of the tightening hole 115B, which maintains alignment between the outlet end 48A of the vaporization pipeline 48 and the tightening hole 115B.

The heat changer 45 further includes a connecting member 213 disposed around the fixture 197. The connecting member 213 includes a flange 215 formed on an end thereof. The connecting member 213 may, but not limited to, be made of Telfon.

The heat exchanger 45 further includes two supporting portions 113 disposed on an outer side of the thermally conductive member 111 and spaced from the ejection portion 115. The two supporting portions 113 of the heat exchanger 45 are coupled with the second side 133 of the inner casing 117. The distal end of the ejection portion 115 extends through the through-hole 131 and out of the inner casing 117. Furthermore, the outer periphery of the ejection portion 115 and the inner periphery of the through-hole 131 are welded together, such that the ejection portion 115 is in sealing contact with the inner periphery of the through-hole 131 to avoid passage of water. Furthermore, the heat exchanger 45 is nearly hung in the inner casing 117 through each supporting portion 113 and the ejection portion 115. In other words, the heat exchanger 45 and the inner casing 117 have a low heat exchange efficiency therebetween, which reduces the influence of the inner casing 117 on the working operating temperature of the heat exchanger 45, thereby avoiding dropping of temperature. Furthermore, a temperature maintaining member 217 is disposed between the thermally conductive member 111 of the heat exchanger 45 and the inner casing 117 (see FIGS. 3A and 4A) to reduce the heat exchange efficiency between the thermally conductive member 111 and the air. The temperature maintaining member 217 may, but not limited to, be made of heat preservation cotton.

The heating module 40 further includes an outer casing 135 and a spacer 42B. The outer casing 135 includes an outer end wall 137 and an inner end face 152 spaced from the outer end wall 137. The outer casing 135 further includes a bottom 151 extending between the outer end wall 137 and the inner end face 152. The outer casing 135 further includes a through-hole 139 extending through the outer end wall 137. The inner end face 152 includes a vent 153. The through-hole 139 has an inner diameter greater than an outer diameter of the ejection portion 115

With reference to FIGS. 1B and 4A-4C, the inner end face 152 of the outer casing 135 includes a plurality of first waterproof kits 230A. Each of the plurality of first waterproof kits 230A includes a body 231 having a first side 233 and a second side 235. Each body 231 further includes a coupling hole 237 extending from the first side 233 through the second side 235 and a squeezing chamber 239. Each body 231 is fixed to the inner end face 152 of the outer casing 135. The second side 235 of each body 231 extends into the outer casing 135, and the first side 233 is located outside of the outer casing 135. Each body 231 and the inner end face 152 have a sealing ring therebetween. An outer threading is disposed on the second side 235 of each body 231 and is in threading connection with a nut, such that each body 231 is in waterproof contact with the inner end face 152.

Each of the plurality of first waterproof kits 230A further includes a locking cover 253 and a squeezing member 251. Each squeezing member 251 is received in an associated squeezing chamber 239. Each locking cover 253 is in threading connection with the first side 233 of an associated body 231. The coupling hole 237 and the squeezing member 251 of the body 231 of one of the plurality of first waterproof kits 230A are coupled with the inlet end 48B of the vaporization pipeline 48 (see FIG. 4A). The coupling hole 237 and the squeezing member 251 of the body 231 of each of the remaining first waterproof kits 230A are coupled with a power supply line of the heater 46, a temperature sensor line, and an overheat protection switch line. After the locking cover 253 of each of the plurality of first waterproof kits 230A is rotated to a tightened state, each squeezing member 251 can deform to be in waterproof contact with an associated body 231 and the inlet end 48B, the power supply line of the heater 46, the temperature sensor line, and the overheat protection switch line. Therefore, water is difficult to leak into the interior of the outer casing 135 via the gap in passageways through which the pipes or lines of the outer casing 135 extend.

With reference to FIGS. 3A-4A, the inner casing 117 and the heat exchanger 45 are received in the outer side of the outer casing 135. Namely, the inner casing 117 is located between the heat exchanger 45 and the outer casing 135. The first side 119 is spaced from the outer end wall 137. The outer end wall 137 is located between the first end wall 32 and the first side 119. The through-hole 139 of the outer casing 135 is aligned with the through-hole 131. The bottom of the inner casing 117 is fixed to the bottom 151 of the outer casing 135. The ejection portion 115 of the heat exchanger 45 extends through the through-hole 139 to the outer side of the outer casing 135. A portion the ejection portion 115 near the distal end is coupled with the outer protecting ring 171. The distal end of the ejection portion 115 is received in the countersink 175 and is located between the outer side 173 and the end wall of the countersink 175.

The spacer 343B is fixed to the bottom wall 36 of the housing 20 and is located between the bottom 151 of the outer casing 135 and the bottom wall 36 of the housing 20. Thus, the heating module 40 is spaced from the bottom wall 36 of the housing 20 and the plurality of through-holes 36B.

The through-hole 153 of the outer casing 135 is coupled with a first venting valve 78A. The first venting valve 78A includes a protrusion 82. The protrusion 82 includes a first end face 82A, a second end face 82B spaced from the first end face 82A, and an outer periphery 88 extending between the first end face 82A and the second end face 82B. In this embodiment, the first venting valve 78A further includes a coupling portion 84 extending from the first end face 82A away from the second end face 82B. The first venting valve 78A further includes an inner passageway 86 extending from an end face of the coupling portion 84 towards but spaced from the second end face 82B. The first venting valve 78A further includes a chamber 92 extending from the inner passageway 86 towards but spaced from the second end face 82B. Thus, the chamber 92 is located between the inner passageway 86 and the second end face 82B and is spaced from the second end face 82B. The first venting valve 78A further includes four outer passageways 90 each extending radially from the outer periphery 88 of the protrusion 82 and intercommunicating with the chamber 92. The four outer passageways 90 are spaced from each other at an equal interval in a circumferential direction of the first venting valve 78A. Furthermore, an air-permeable waterproof member 94 is securely disposed in the chamber 92 of the first venting valve 78A. The air-permeable waterproof member 94 can, but not limited to, be made of air-permeable waterproof nonwoven.

The coupling portion 84 of the first venting valve 78A is in threading connection with the vent 153 of the outer casing 135. A sealing gasket may be disposed between the first end face 82A of the first venting valve 78A and the inner end face 152 of the outer casing 135 to enable sealing coupling between the first venting valve 78A and the outer casing 135. Thus, the interior of the outer casing 135 can intercommunicate with the installation space 30 of the housing 20 via the first venting valve 78A. Furthermore, the air-permeable waterproof member 94 can effectively avoid passage of water molecules.

The smoke generator 10 further comprises a closure plate 155 coupled with the outer casing 135 and the ejection portion 155. The closure plate 155 includes a closure face 157 and a coupling hole 159 extending through the closure face 157. The coupling hole 159 has an inner periphery 160.

With reference to FIG. 3B, the closure face 157 of the closure plate 155 abuts an inner side of the outer end wall 137 of the outer casing 135. The coupling hole 159 is aligned with the through-hole 139. Waterproof welding is carried out between the closure plate 155 and the outer casing 135. The coupling portion 115D of the ejection portion 115 is coupled with the coupling hole 159 of the closure plate 155. A circular sealing welding is carried out between the inner periphery 160 of the coupling hole 159 and the surface of the coupling portion 115D. A peripheral wall delimiting the coupling hole 159 of the closure plate 155 is sandwiched between a tail end of the fixture 197 and the wall face of the coupling portion 115D of the ejection portion 115. Thus, water cannot pass through a gap between the closure plate 155 and the outer end wall 137.

With reference to FIG. 3B, the flange 215 of the connecting member 213 is sandwiched between the inner side 174 of the outer protecting ring 171 and the closure face 157 of the closure plate 155. An end of the connecting member 213 distant to the flange 215 is coupled with the outer protecting ring 171 and is located between the first end wall 32 and the outer side 173. Namely, the connecting member 213 is received in the countersink 175 of the outer protecting ring 171, and the outer end face of the connecting member 213 is located between the outer end face of the outer protecting ring 171 and the outer end wall 137 of the outer casing 137 in the longitudinal direction of the connecting member 213.

In a preferred embodiment, the thickness of the closure plate 155 is smaller than the thickness of the outer casing 135. For example, the closure plate 155 is in the form of a sheet having a thickness of 0.2-0.3 mm. Thus, the contact area between the closure plate 155 and the ejection portion 115 will be relatively small, such that the coupling between the closure plate 155 and the ejection portion 115 provides a low heat exchange efficiency therebetween. As a result, the closure plate 155 will not cause sudden reduction of the temperature of the ejection portion 115. Therefore, the temperature of the ejection portion 115 can be easily maintained at the working temperature (normally expected to be above 200° C.).

The smoke generator 10 further comprises a second casing 52 received in the installation space 30 and a supply module 50 coupled with the second casing 52. The second casing 52 includes a horizontal separation board 54 and a coupling end 52A spaced from the horizontal separation board 54. The horizontal separation board 54 has a through-hole 54B. Three sides of the horizontal separation board 54 respectively abut the two sidewalls 34 and the bottom wall 36. The second casing 52 divides the installation space 30 into a portion between the first end wall 32 and the horizontal separation board 54 and another portion between the horizontal separation board 54 and the second end 24. Furthermore, the plurality of drain holes 36A are aligned with the second casing 52. Each of the plurality of through-holes 36B is located between the first end wall 32 and the horizontal separation board 54.

The supply module 50 includes a storage tank 56 coupled with the second casing 52. The storage tank 56 is used to store an oil (or so-called "smoke oil") which subsequently vaporizes into smoke. In this embodiment, an upper opening of the storage tank 56 is on an outer side of the installation space 30.

The smoke generator 10 further comprises a third casing 59 and a control module 58 received in the third casing 59. The third casing 59 includes a first end 60 and a second end 61 spaced from the first end 60. The third casing 59 further includes an abutting face 62 on each of two sides of the first end 60. The third casing 59 further includes a chamber 64 extending to an upper end thereof to form an opening. The third casing 59 further includes a side opening 59A (see FIG. 7) located between the first end 60 and the second end 61. The side opening 59A intercommunicates with the chamber 64. The smoke generator 10 further comprises a waterproof gasket 66A, an upper cover 66, a side cover 59B, and a waterproof side gasket 59C. The upper cover 66 closes the chamber 64. The waterproof gasket 66A is disposed between the chamber 64 and the upper cover 66. Thus, water is difficult to leak into the chamber 64.

The third casing 59 is received in the installation space 30 and is located on the second end 24 of the housing 20. The second end 24 abuts the abutting faces 62. Thus, the third casing 59 closes the opening of the installation space 30 at the second end 24. Furthermore, the second end 61 of the third casing 59 is contiguous to the coupling end 52A of the second casing 52. Thus, the third casing 59 cooperates with the second casing 52 to position the supply module 50.

The control module 58 includes a pump 68, a controller 70, and a network connector seat 71 electrically connected to the controller 70. The pump 68, the controller 70, and the network connector seat 71 are received in the chamber 64 of the third casing 59. The network connector seat 71 is aligned with the side opening 59A (see FIG. 7). The pump 68 and the heater 46 are in electrical connection with the controller 70. The inlet end 48B of the vaporization pipeline 48 extends through the through-hole 54B of the horizontal separation board 54 and enters the interior of the third casing 59 to connect with the pump 68. The pump 68 is connected with the storage tank 56. The controller 70 controls operation of the heater 46 and the pump 68. The pump 68 can be activated to deliver the smoke oil in the storage tank 56 towards the outlet 38 along the vaporization pipeline 48.

Figure 7:
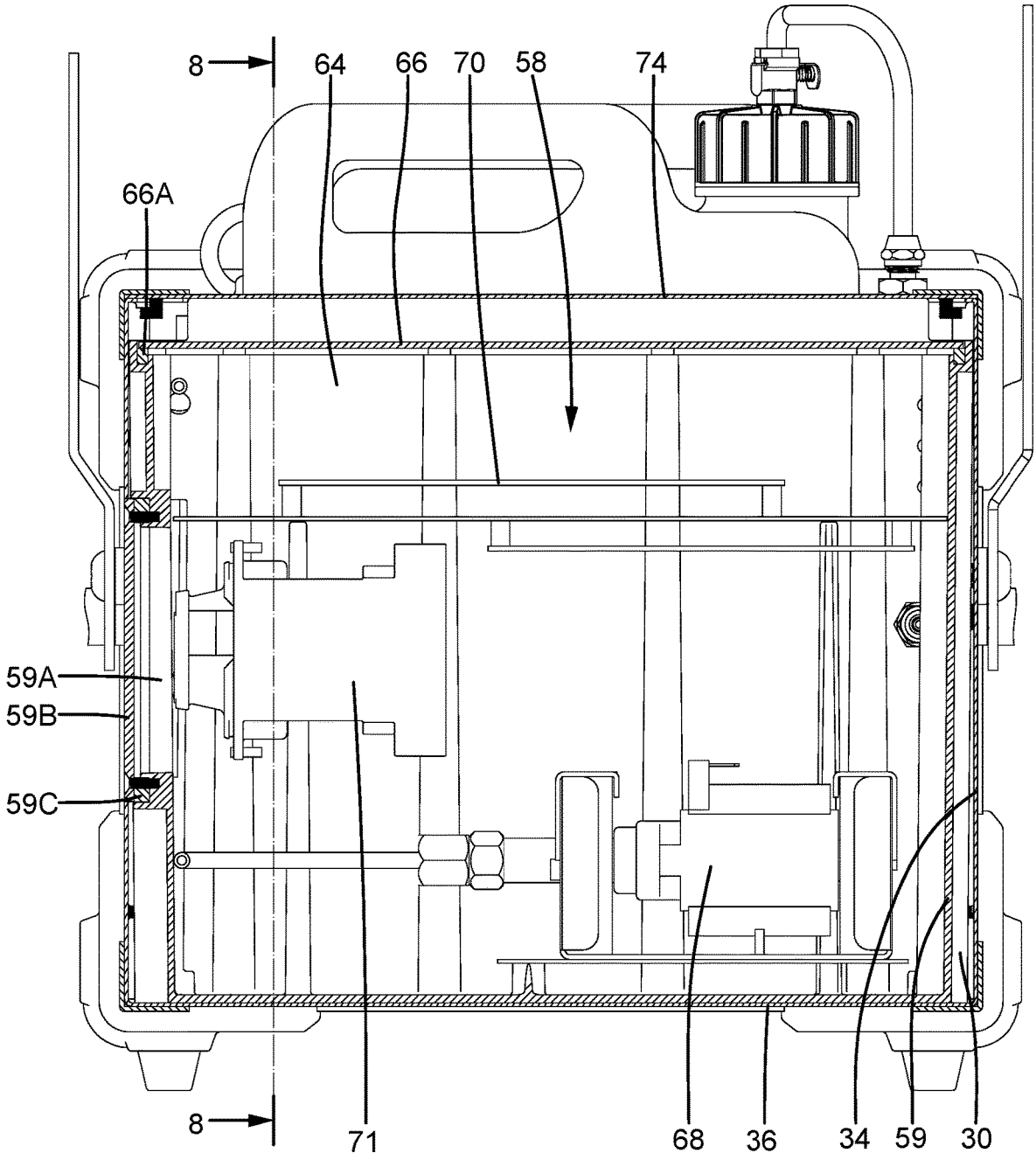
FIG. 7 is a cross sectional view taken along section line 7-7 of FIG. 2.

With reference to FIG. 7, the waterproof side gasket 59C is disposed around the side opening 59A. The side cover 59B is detachably disposed to cover the side opening 59A and abuts against the waterproof side gasket 59C. Thus, when the network connection seat 71 is not in use, the chamber 64 is sealed to prevent entrance of water. When it is desired to control the smoke generator 10 via a network, the side cover 59B is detached, and a wireless antenna is installed to permit control of the smoke generator 10 through the network and software.

A plurality of second waterproof kits 230B is disposed on the third casing 59. Each of the plurality of second waterproof kits 230B may be substantially the same as each first waterproof device 230, and the structural features thereof is not set forth to avoid redundancy. The power supply line, the temperature sensor line, and the overheat protection switch line may extend into the chamber 64 of the third casing 59 and in electrical connection with the control module 58. The plurality of second waterproof kits 230B fixed on the third casing 59 is in waterproof coupling with the third casing 59, the inlet end 48B, the power supply line, the temperature sensor line, and the overheat protection switch line of the heater 46, and the pipeline of the storage tank 56, such that water is difficult to pass through the gaps between these pipelines or lines and the third casing 59.

The smoke generator 10 further includes an outer cover 74 having an opening 76. The outer cover 74 is securely coupled with the upper wing 28 and the second casing 52. The storage tank 56 extends through the opening 76. The plurality of drain holes 36A is aligned with the opening 76. The outer cover 74, the second casing 52, and the housing 20 define an enclosing area 30B in the installation space 30. The enclosing area 30B is located between the first end wall 32 and the horizontal separation board 54. The outer cover 74 can cooperate with the upper wing 28 to reduce the amount of water that may leak into the enclosing area 30B.

Figure 1A:
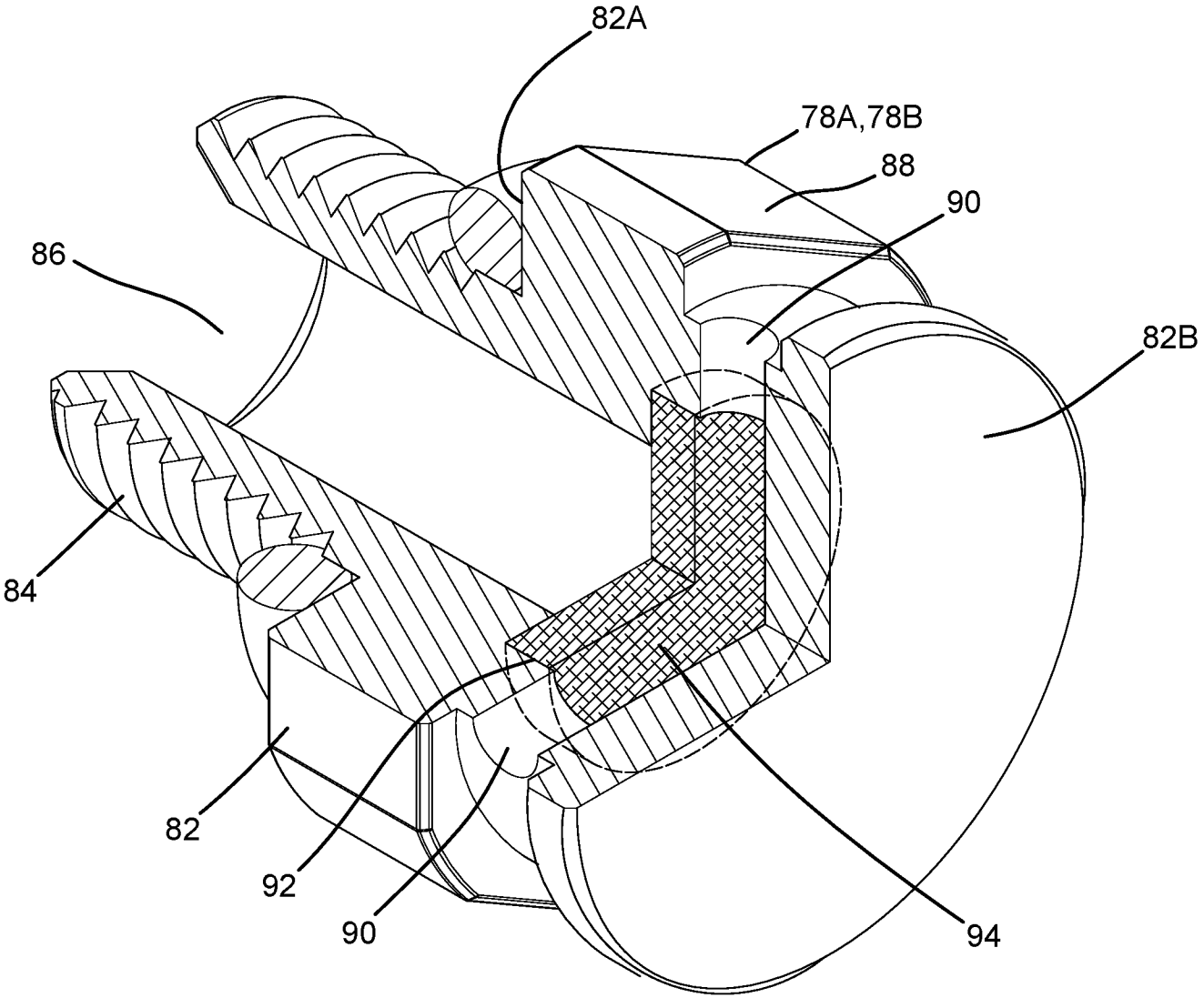
FIG. 1A is a partly-cutaway perspective view of a first venting valve of the smoke generator of FIG. 1.
Figure 1B:
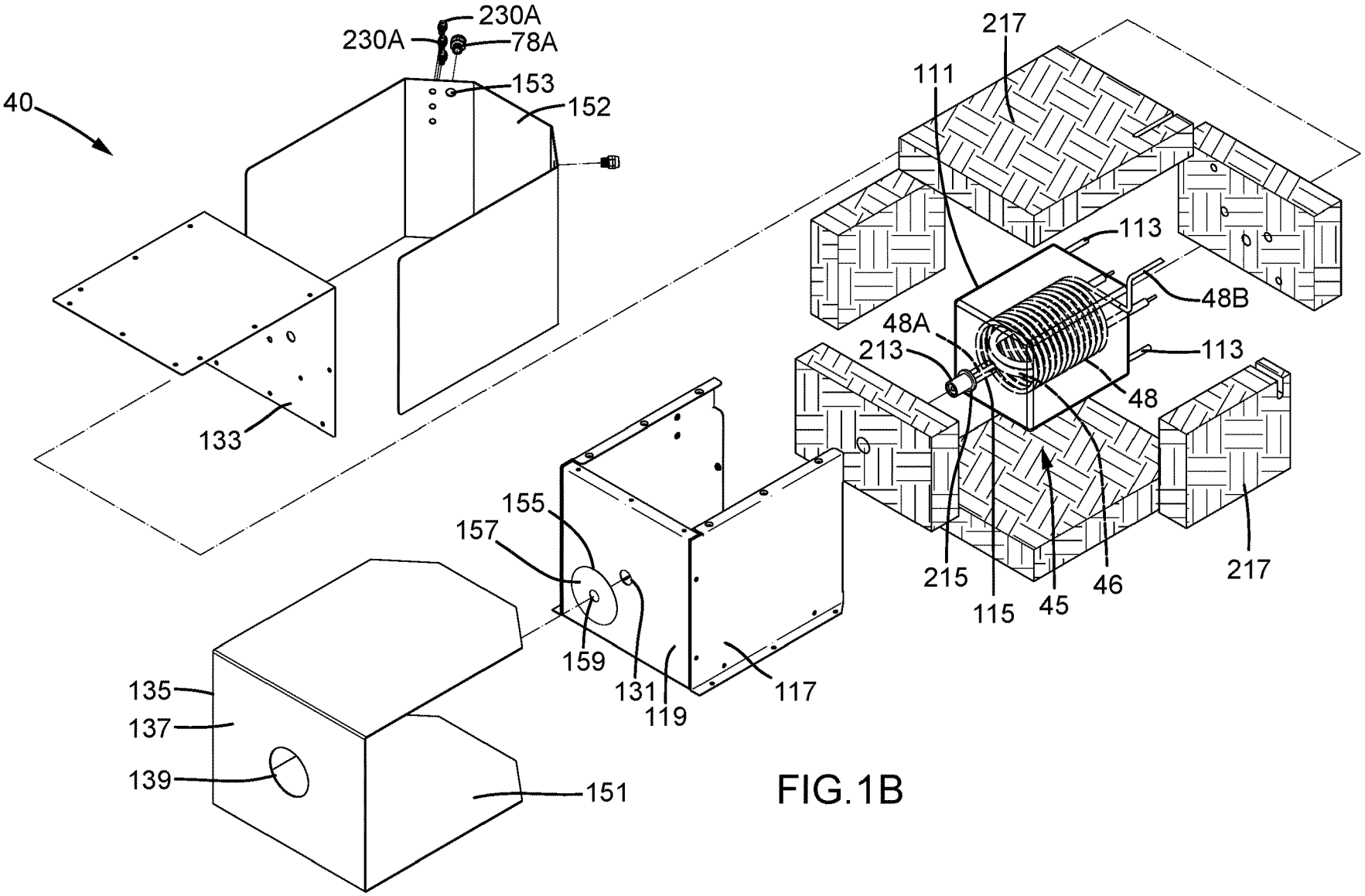
FIG. 1B is an exploded, perspective view of a heating module of the smoke generator of FIG. 1.
Figure 1C:
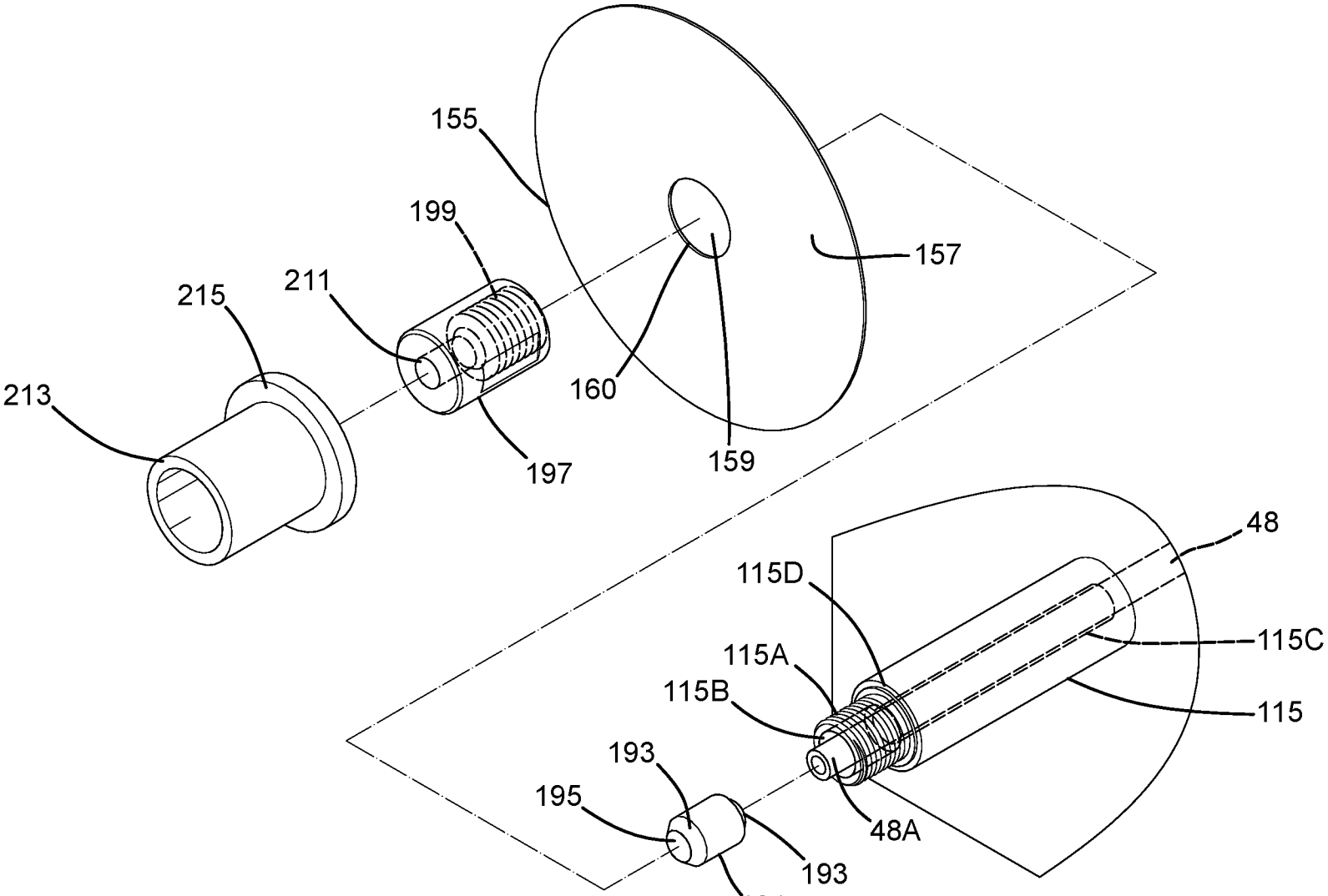
FIG. 1C is an exploded, perspective view of a portion of a heat exchanger of FIG. 1B.
Figure 2:
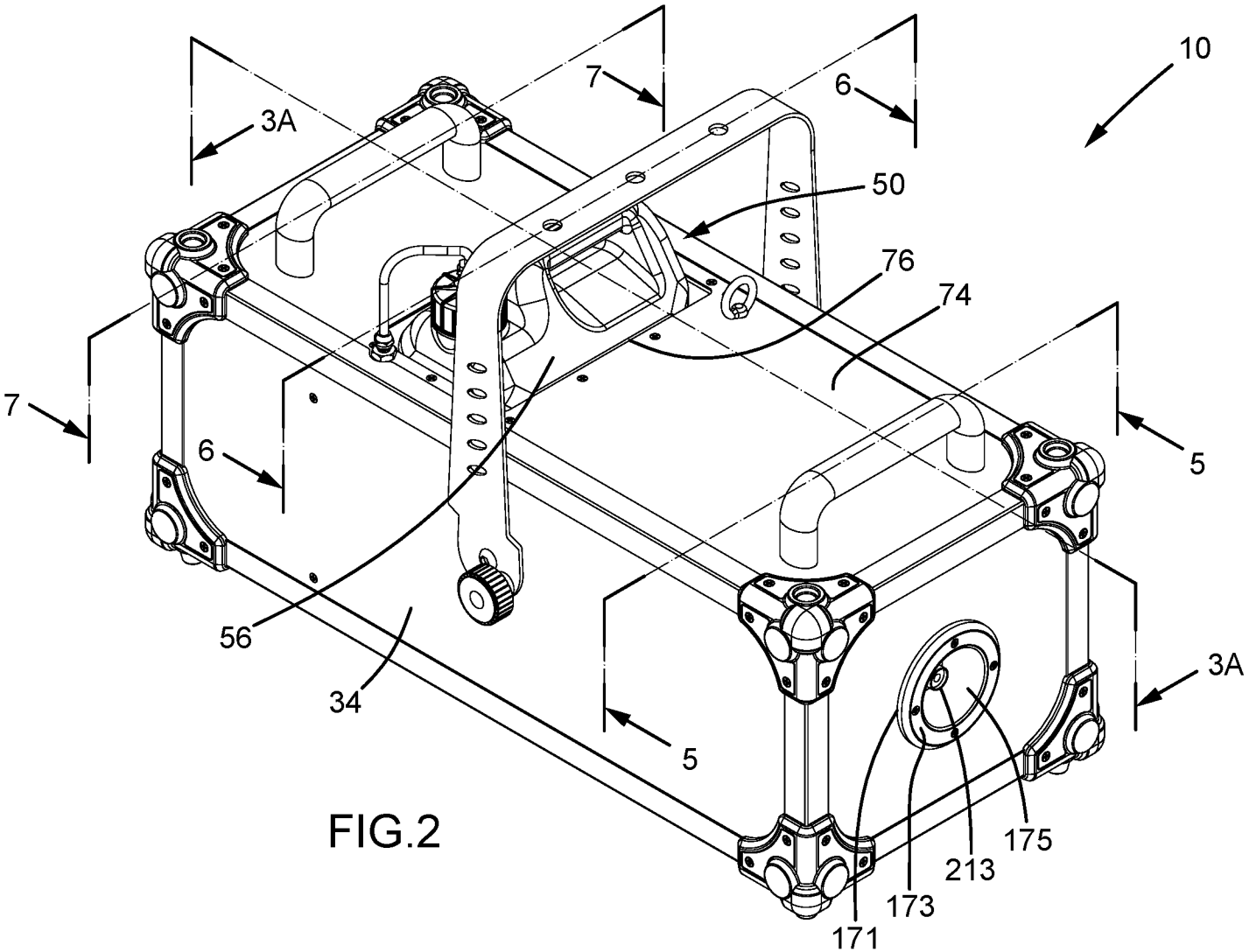
FIG. 2 is a perspective view of the smoke generator of FIG. 1 after assembly.
Figure 8:
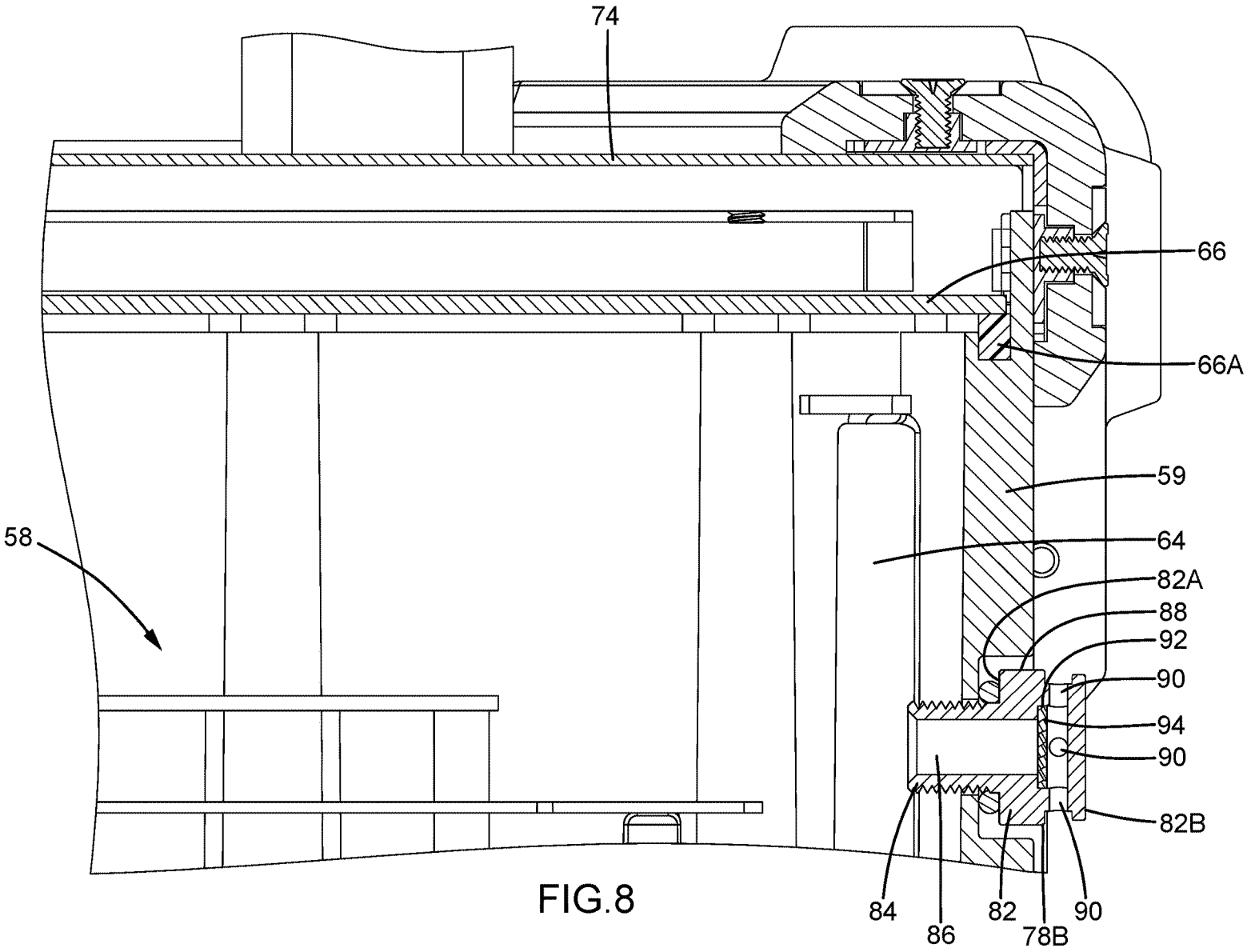
FIG. 8 is a cross sectional view taken along section line 8-8 of FIG. 7.

With reference to FIGS. 1A and 8, the smoke generator 10 according to the present invention further comprises a second venting valve 78B having a structure which may be identical to the venting valve 78A, and the structural features of the second venting valve 78B is not set forth to avoid redundancy. The second venting valve 78B is disposed in a location different from that of the first venting valve 78A.

With reference to FIG. 8, the second venting valve 78B is securely disposed on the first end 60 of the third casing 59. The inner passageway 86 of the second venting valve 78B intercommunicates with the chamber 64 of the third casing 59. Each outer passageway 90 of the second venting valve 78B intercommunicates with the atmosphere.

The technical features of the present invention have been explained. It can be appreciated when it is desired to make the smoke generator 10 generate smoke, the pump 68 and the heater 46 are activated. The pump 68 delivers the smoke oil in the storage tank 56 to the vaporization pipeline 48. The heater 46 heats the vaporization pipeline 48 via the thermally conductive member 111. Thus, the smoke oil flowing along the vaporization pipeline 48 absorbs the heat of the vaporization pipeline 48 and vaporizes into smoke which is ejected via the outlet 38 into the air to provide a smoky effect.

It is worth mentioning that when the smoke generator 10 operates, the temperatures of the heater 40 and the control module 58 rise during operation. Thus, the air is heated, and the pressures inside the inner casing 117 and the chamber 64 increase. The pressure in the inner casing 117 (which is not sealed) can flow into the outer casing 135, and the air expanding in the outer casing 135 can flow from the inner passageway 86 of the first venting valve 78A through the air-permeable waterproof member 94 and can be discharged into the enclosing area 30B via each outer passageway 90 and then discharged to the atmosphere via each through-hole 36B. The air in the chamber 64 can flow from the inner passageway 86 of the second venting valve 78B through the air-permeable waterproof member 94 and is then discharged to the atmosphere via each outer passageway 90.

When the smoke generator 10 is not in operation, the temperatures of the heating module 40 and the control module 59 drop, such that the temperature of the heat exchanger 45 is reduced. Thus, the pressure of the air inside the inner casing 117 is reduced the air cools down. The atmospheric air enters the enclosing area 30B via each through-hole 36B and then passes through each outer passageway 90 of the first venting valve 78A, the air-permeable waterproof member 94 and the inner passageway 86, and finally enters the outer casing 135 and the inner casing 117. Thus, the pressure of the heating module 40 is kept substantially the same as the atmospheric pressure during operation and non-operation period.

The atmospheric air also passes through each outer passageway 90 of the second venting valve 78B and enters the inner passageway 86 via the air-permeable waterproof member 94 and then enters the chamber 64. Thus, the pressure in the chamber 64 is kept substantially the same as the atmospheric pressure. Since the atmospheric air entering either of the enclosing area 30B and the chamber 64 will pass through the air-permeable waterproof member 94, the excessive moisture in the air will be stopped by the air-permeable waterproof members 94 in the first venting valve 78A and the second venting valve 78B. Thus, the enclosing area 30B and the chamber 64 will be kept at a proper humidity.

The smoke generator 10 according to the present invention can balance the pressure in the heating module 40 and the atmospheric pressure by disposing the first venting valve 78A on the outer casing 135 of the heating module 40, further enhancing the waterproof effect of the heating module 40.

The closure plate 155 is in waterproof coupling with the outer casing 135 and the ejection portion 115, such that water cannot enter the interior of the inner casing 117 via the gap between the closure plate 155 and the outer casing 135 and the gap between the closure plate 155 and the ejection portion 115, thereby providing excellent waterproof effect.

The outer casing 135 encloses the inner casing 117 and the heat exchanger 45 to avoid water from contacting with the inner casing 117 and the heat exchanger 45, thereby enhancing the waterproof effect of the heating module 40.

The closure plate 155 and the ejection portion 115 are so coupled that the heat exchange efficiency therebetween is relatively low, such that the closure plate 155 has low influence on the temperature of the ejection portion 155. Thus, the temperature of the ejection portion 115 can be maintained at a proper temperature (which is expected to be at least above 200° C.) more easily.

The thickness of the closure plate 155 is 0.2-0.3 mm, such that the contact area between the closure plate 155 and the ejection portion 115 is very small. Thus, the heat conduction efficiency between the closure plate 155 and the ejection portion 115 is relatively low.

When the tightening member 191 is squeezed by the fixture 197, the tightening member 191 is in waterproof coupling with the outlet end 48A of the vaporization pipeline 48, and the tightening member 191 is also in waterproof coupling with the ejection portion 115. Thus, water is difficult to enter the ejection portion 115, and the ejection portion 115 can be maintained at the working temperature (above 200° C.) more easily.

The coupling portion 115D is provided on the ejection portion 115, and the peripheral wall delimiting the coupling hole 159 of the closure plate 155 is sandwiched between the fixture 197 and the coupling portion 115D, such that water is difficult to pass through the gap between the ejection portion 115 and the closure plate 155, thereby enhancing the waterproof effect.

The inner periphery 160 of the closure plate 155 and the coupling portion 115D are welded together, such that water is difficult to pass through the gap between the ejection portion 115 and the closure plate 155, thereby enhancing the waterproof effect.

The inner casing 117 cooperates with the outer casing 135 to reduce the chance of water entering or contacting with the heat changer 45, such that the heat exchanger 45 can be better maintained at the working temperature.

The temperature maintaining member 217 can reduce the heat exchange efficiency between the heat exchanger 45 and the air, such that the heat exchanger 45 can be better maintained at the working temperature.

The smoke generator 10 according to the present invention can adjust the pressure in the chamber 64 of the third casing 59 by disposition of the second venting valve 78B. Furthermore, the air-permeable waterproof member 94 of the second venting valve 78B can block excessive moisture in the air to maintain a proper humidity in the chamber 64. Thus, the control module 58 is less likely to be damaged by excessive moisture. As a result, the smoke generator 10 can be used outdoor.

The third casing 59 cooperates with the waterproof gasket 66A via the upper cover 66 to prevent water from leaking into the chamber 64, such that the control module 58 is less likely to be damaged.

The outlet end 48A of the vaporization pipeline 48 is received in the receptacle 211 of the fixture 197, and the end face of the outlet end 48A and is located between the outer end face of the fixture 197 and the tightening member 191 in a longitudinal direction of the fixture 197, such that the vaporization pipeline 48 is less likely to contact with water while reducing the contact area with air. Thus, the outlet end 48A can be maintained at the working temperature more easily.

The connecting member 213 is received in the countersink 175 of the outer protecting ring 171, and the outer end face of the connecting member 213 is located between the outer end face of the outer protecting ring 171 and the outer end wall 137 of the outer casing 137 in the longitudinal direction of the connecting member 213, such that the vaporization pipeline 48 and the ejection portion 115 are less likely to contact with water while reducing the contact area with air. Thus, the outlet end 48A and the ejection portion 115 can be maintained at the working temperature more easily.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A waterproof heating module for a smoke generator, with the waterproof heating module comprising:

a heat exchanger including an ejection portion and a vaporization pipeline, wherein the vaporization pipeline includes an outlet end, wherein the ejection portion includes an engaging end and a tightening hole extending from the engaging end, and wherein the outlet end of the vaporization pipeline is coupled with the ejection portion;

a tightening member including a sealing hole, wherein the tightening member is received in the tightening hole and is sandwiched between the ejection portion and the outlet end of the vaporization pipeline; and a fixture including a receptacle, wherein the fixture is coupled with the coupling end of the ejection portion and is configured to squeeze the tightening member to provide waterproof coupling between an inner surface of the sealing hole of the tightening member and an outer surface of the outlet end of the vaporization pipeline, and wherein an outer surface of the tightening member is in waterproof coupling with an inner surface of the tightening hole of the ejection portion.

2. The waterproof heating module for the smoke generator as claimed in claim 1, wherein an end face of the outlet end of the vaporization pipeline is located between an end face of the fixture and the tightening member, wherein the tightening member includes two conic faces on two ends thereof, wherein a distal end of the tightening hole of the ejection portion is a conic face, wherein when the tightening member is squeezed, the tightening member is aligned with a central axis of the tightening hole of the ejection portion.

3. A waterproof heating module for a smoke generator, with the waterproof heating module comprising:

a heat exchanger including an ejection portion configured to eject smoke;

an outer casing including a through-hole, wherein the heat exchanger is received in an inner side of the outer casing, wherein the ejection portion extends through the through-hole of the outer casing to an outer side of the outer casing; and a closure plate including a closure face and a coupling hole extending through the closure face, wherein the coupling hole of the closure plate has an inner periphery in waterproof coupling with an outer periphery of the ejection portion, wherein the ejection portion extends out of the closure plate via the coupling hole, and wherein the closure face of the closure plate is in waterproof coupling with the through-hole of the outer casing.

4. The waterproof heating module for the smoke generator as claimed in claim 3, wherein the closure plate is a sheet having a thickness of 0.2-0.3 mm, such that the inner periphery of the closure plate and the outer periphery of the ejection portion are coupled to have a low heat exchange efficiency therebetween.

5. The waterproof heating module for the smoke generator as claimed in claim 3, wherein the ejection portion includes a coupling portion, wherein the inner periphery of the closure plate is disposed around the coupling portion, and wherein the inner periphery of the closure plate and the coupling portion are welded together.

6. The waterproof heating module for the smoke generator as claimed in claim 5, further comprising a fixture, wherein the ejection portion includes an engaging end and a coupling portion contiguous to the engaging end, wherein the inner periphery of the closure plate is disposed around the coupling portion, wherein a peripheral wall delimiting the coupling hole of the closure plate is securely sandwiched between the fixture and the coupling portion, and wherein the inner periphery of the closure plate and the coupling portion are welded together to provide a waterproof coupling therebetween.

7. The waterproof heating module for the smoke generator as claimed in claim 3, further comprising an inner casing and a temperature maintaining member, wherein the inner casing is disposed between the outer casing and the heat exchanger, wherein the heat exchanger and the inner casing are coupled to have a low heat exchange efficiency therebetween, wherein the ejection portion is in waterproof coupling with the inner casing, wherein the temperature maintaining member is disposed between the inner casing and the heat exchanger, and wherein the temperature maintaining member reduces heat exchange efficiency between the heat exchanger and air.

8. The waterproof heating module for the smoke generator as claimed in claim 3, further comprising a first venting valve capable of preventing passage of water, wherein the first venting valve includes a flange having a first end face and a second end face spaced from the first end face, wherein the first venting valve further includes a coupling portion extending from the first end face away from the second end face, wherein the first venting valve further includes an inner passageway extending from the coupling portion and a chamber located between the inner passageway and the second end face, wherein the first venting valve further includes an outer passageway extending from an outer periphery of the flange and extending to and intercommunicating with the chamber, wherein the inner passageway intercommunicates with an interior of the outer casing, and wherein an air-permeable waterproof member is securely disposed in the chamber.

9. The waterproof heating module for the smoke generator as claimed in claim 3, further comprising a plurality of first waterproof kits, wherein each of the plurality of first waterproof kits includes a body coupled to the outer casing, a squeezing member, and a locking cover, wherein each body includes a coupling hole and a squeezing chamber intercommunicating with the coupling hole, wherein each squeezing member is received in an associated squeezing chamber, wherein each locking cover is in threading connection with an associated body, wherein the heat exchanger further includes a vaporization pipeline and a heater configured to conduct heat exchange with the vaporization pipeline, wherein the vaporization pipeline further includes an inlet end, wherein a line for the heater extends to an outer side of the outer casing, wherein the coupling hole and the squeezing member of one of the plurality of first waterproof kits is coupled with the inlet end of the vaporization pipeline, wherein the coupling holes and the squeezing members of remaining first waterproof kits are coupled with the line for the heater, and wherein when the locking covers of the plurality of first waterproof kits are rotated to a tightened state, the squeezing member of the one of the plurality of first waterproof kits is waterproof coupling with the inlet end of the vaporization pipeline and an associated body, and the squeezing members of the remaining first waterproof kits are in waterproof coupling with the line for the heater and associated bodies.

10. The waterproof heating module for the smoke generator as claimed in claim 3, further comprising a tightening member and a fixture, wherein the heat exchanger further includes a vaporization pipeline having an outlet end, wherein the ejection portion includes an engaging end and a tightening hole extending from the engaging end, wherein the tightening member includes a sealing hole, wherein the tightening member is received in the tightening hole and is disposed between the outlet end of the vaporization pipeline and the ejection portion, wherein the fixture has a receptacle, wherein the fixture is coupled with the engaging end of the ejection portion and is configured to squeeze the tightening member to provide waterproof coupling between an inner surface of the sealing hole and an outer surface of the outlet end of the vaporization pipeline, wherein an outer surface of the tightening member is in waterproof coupling with an inner surface of the tightening hole of the ejection portion, and wherein the vaporization pipeline is aligned with the receptacle.

11. The waterproof heating module for the smoke generator as claimed in claim 10, wherein an end face of the outlet end is located between an end face of the fixture and the tightening member, wherein the tightening member includes two conic faces on two faces thereof, wherein a distal end of the tightening hole is conic, and wherein when the tightening member is squeezed, the tightening member is aligned with a central axis of the tightening hole.

* * * * *